United States Patent [19]

Nishida et al.

[11] 3,987,337

[45] Oct. 19, 1976

[54] PLASMA DISPLAY PANEL HAVING ADDITIONAL DISCHARGE CELLS OF A LARGER EFFECTIVE AREA AND DRIVING CIRCUIT THEREFOR

[75] Inventors: Kazunori Nishida; Tsunekiyo Iwakawa; Hiroshi Hada, all of Tokyo, Japan

[73] Assignee: Nippon Electric Company, Ltd., Tokyo, Japan

[22] Filed: Feb. 4, 1975

[21] Appl. No.: 546,894

[30] Foreign Application Priority Data

Feb. 7, 1974 Japan ..... 49-15704[U]
Apr. 3, 1974 Japan ..... 49-37705

[52] U.S. Cl. ..... 315/168; 313/518; 313/217; 315/169 TV

[51] Int. Cl.[2] ..... H01J 61/067; H01J 61/54; H05B 41/16; H05B 41/30

[58] Field of Search ..... 315/169 TV, 168; 340/324 M; 313/188, 518, 217

[56] References Cited

UNITED STATES PATENTS

| | | | |
|---|---|---|---|
| 3,559,190 | 1/1971 | Bitzer et al. | 315/169 R X |
| 3,609,658 | 9/1971 | Soltan | 313/188 X |
| 3,614,769 | 10/1971 | Coleman et al. | 340/324 M |
| 3,644,925 | 2/1972 | Kupsky | 315/169 TV X |
| 3,711,733 | 1/1973 | Skutt | 315/169 TV X |
| 3,808,501 | 4/1974 | Iwakawa et al. | 315/169 TV |
| 3,878,420 | 4/1975 | Fein et al. | 315/169 TV X |

*Primary Examiner*—Palmer C. Demeo
*Attorney, Agent, or Firm*—Hopgood, Calimafde, Kalil, Blaustein & Lieberman

[57] ABSTRACT

A plasma display panel comprising a plurality of electrodes between a pair of dielectric plates that form gas discharge cells is provided with an additional electrode on one of the dielectric plates to form additional gas discharge cells of an effective discharge area larger than the discharge areas of the cells for use in exhibiting a desired display. The effective discharge area may be enlarged either by the use of a wide additional electrode or by application to the additional electrode of a high-frequency voltage whose peak-to-peak value is higher than that of the high-frequency voltages supplied selectively across the display exhibiting cells.

6 Claims, 8 Drawing Figures

PLASMA DISPLAY PANEL HAVING ADDITIONAL DISCHARGE CELLS OF A LARGER EFFECTIVE AREA AND DRIVING CIRCUIT THEREFOR

BACKGROUND OF THE INVENTION

This invention relates to a gas discharge display panel having external electrodes, known generally as a plasma display panel, and a circuit for driving an external electrode gas discharge display panel.

External electrodes are so called because they are disposed externally to the gas discharge cells of a plasma display panel. More particularly, a plasma display panel comprises a pair of dielectric or electrically insulative plates, a set of electrodes on each plate, and a dielectric coating on the electrodes. The dielectric plates are sealed together, with their faces having the electrodes thereon directed inwardly and with a space provided therebetween, which space is filled with an ionizable gas. The electrodes on both plates define a plurality of gas discharge cells. When selectively supplied to the electrodes, high-frequency voltages produce gas discharge in selected cells to exhibit a desired display.

As will later be described with reference to the accompanying drawing, spurious high-frequency voltages are inevitably induced on electrodes disposed adjacent to each of the selected electrodes. The spurious voltages tend to result in an erroneous or, at least, displeasing display. This undesired tendency may be repressed by strictly selecting the peak-to-peak values of the high-frequency voltages in consideration of the individual panels. This has made it impossible to use high-frequency voltages of a sufficiently high peak-to-peak value. In other words, plasma display panels have had narrow ranges of operable voltage.

In order to improve the reliability of the display and to broaden the range of operable voltage, capacitors have been connected to the respective electrodes. Alternatively, an additional electrode may be disposed on one of the dielectric plates between each adjacent pair of the electrodes. The additional electrodes are supplied with a predetermined voltage, such as the ground potential. Unless the capacitors are provided with an additional electrode and an associated dielectric block as taught in U.S. patent application Ser. No. 542,559, filed Jan. 20, 1975, by Hiroshi Hada, Tsutomu Hirayama, and Kazunori Nishida, two of whom are applicants herein, it is difficult to connect the capacitors to the electrodes. Provision of additional electrodes between the respective electrodes inevitably requires that the electrodes for the display be spaced apart on the dielectric plate this deteriorating the resolution of the display. In addition, the capacitances provided by the additional electrodes are not large enough to insure the reliability.

SUMMARY OF THE INVENTION

It is therefore an object of the present invention to provide a plasma display panel capable of exhibiting the desired display with high reliability.

It is another object of this invention to provide a plasma display panel having a wide range of operable voltage.

It is still another object of this invention to provide a plasma display panel with a resolution that is not adversely affected despite the high reliability of the display.

It is yet another object of this invention to provide a plasma display panel which may be readily connected to a driving circuit therefor.

It is a further object of this invention to provide a driving circuit for a plasma display panel of the type described.

As set forth hereinabove and known in the art, a gas discharge panel for exhibiting a selected display, includes a pair of dielectric plates, means for sealing the dielectric plates with an ionizable gas therebetween, and a set of first electrodes on each of thee dielectric plates for defining a plurality of first gas discharge cells for picture elements of the displays to be exhibited by the panel. The first electrodes arranged on the dielectric plates are spaced from the gas discharge cells by dielectric coating means. In accordance with this invention, a second electrode is disposed on one of the dielectric plates for defining a plurality of second gas discharge cells in cooperation with the first electrodes arranged on the other of the dielectric plates. The second electrodes are also spaced from the second gas discharge cells by dielectric coating means which may be the same as or different from the above-mentioned dielectric coating means. It is important that each of the second gas discharge cells should have an effective discharge area larger than the largest discharge area of the first gas discharge cells.

In connection with the concept of this invention set forth in the next preceding paragraph, it is pointed out that a contemporary plasma display panel is capable of providing a display of a plurality of units, such as a number of several digits or a word or words of several letters. In case the plasma display panel is of the segmented electrode type and for use in displaying only one desired numeral or letter at a time, use may be made of only one first electrode disposed on one of the dielectric plates facing the segments arranged on the other dielectric plate. Such a plasma display panel should be understood to be an equivalent of a plasma display panel having a plurality of first electrodes on both of the dielectric plates. Incidentally, each of the first electrodes may have one or more branches or wide portions which directly define the first gas discharge cells.

BRIEF DESCRIPTION OF THE DRAWINGS

For a more complete understanding of the invention, reference may be made to the detailed description below taken in conjunction with the appended drawings wherein.

DESCRIPTION OF THE PREFERRED EMBODIMENTS

Figure 1:
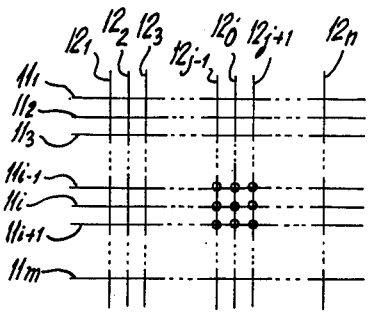
(PRIOR ART) FIG.1
FIG. 1 is a schematic top view of a matrix of electrodes of a conventional plasma display panel.

Before describing several preferred embodiments of the present invention, the operation of a conventional plasma display panel will be described with reference to FIG. 1 in order to facilitate an understanding of this invention. In FIG. 1, a first set of electrodes $11_1$, $11_2$, $11_3$, . . . , $11_{i-1}$, $11_i$, $11_{i+1}$, . . . , and $11_m$ are arranged parallel to each other on a first dielectric plate (not shown). A second set of electrodes $12_1$, $12_2$, $12_3$, . . . , $12_{j-1}$, $12_j$, $12_{j+1}$, . . . , and $12_n$ are disposed on a second dielectric plate (not shown) perpendicularly of the first electrodes 11 but spaced therefrom. For convenience of description, the suffixes are omitted as in the latter portion of the preceding sentence, and hereinafter reference numerals refer to the relevant elements in general rather than to a specific element. When the electrodes $11_i$ and $12_j$ are selectively supplied with high-frequency voltages of opposite polarities, a gas discharge occurs in a gas discharge cell placed between these electrodes as shown in the drawing by a dot at the point of intersection. Due to the inevitable coupling between electrodes, spurious high-frequency voltages are induced on the adjacent electrodes, such as the electrodes $11_{i-1}$, $11_{i+1}$, $12_{j-1}$, and $12_{j+1}$. Peak-to-peak value of spurious high-frequency voltages applied across the adjacent gas discharge cells amount to as much as 90% of the high-frequency voltage supplied across the selected cell and are approximately proportionate to the latter voltage. This fact results in the various disadvantages mentioned in the preamble of the instant specification.

Figure 2:
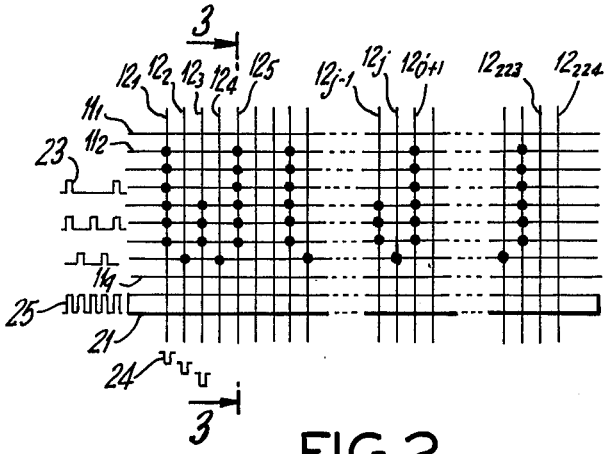
FIG. 2 schematically shows electrodes arranged in a matrix form of a plasma display panel according to a first embodiment of the instant invention.
Figure 3:
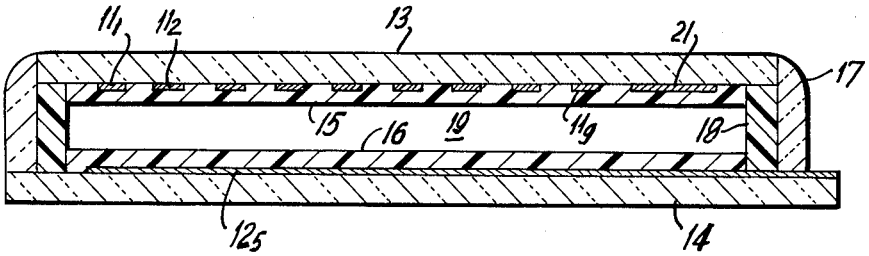
FIG. 3 is a schematic cross-sectional view taken along a plane represented by a line 3—3 on the plasma display panel depicted in FIG. 2.

Referring to FIGS. 2 and 3, a plasma display panel according to a first embodiment of this invention comprises a first set of electrodes $11_1$, $11_2$, . . . , and $11_9$ and a second set of electrodes $12_1$, $12_2$, $12_3$, $12_4$, $12_5$, . . . , $12_{j-1}$, $12_j$, $12_{j+1}$, . . . , $12_{223}$, and $12_{224}$. The first and second sets of electrodes 11 and 12 are arranged parallel on first and second dielectric plates 13 and 14 and covered by first and second continuous dielectric coatings 15 and 16, respectively. The electrodes 11 and 12 are spaced apart on the respective dielectric plates 13 and 14 by a first and a second pitch or distance. These two pitches may be equal. The dielectric plates 13 and 14 are hermetically sealed by a mass 17 of sealing glass with a spacer 18 interposed therebetween to leave a space 19 and with the ends of the electrodes 11 and 12 extended outwardly of the glass mass 17 to facilitate electrical connection to a driving circuit (FIGS. 6 and 8) therefor. The space 19 is evacuated and thereafter filled with an ionizable gas, such as neon or a mixture of inert gases. The electrodes 11 and 12 are disposed on the dielectric plates 13 and 14 so as to form a matrix and to define a plurality of gas discharge cells.

Further referring to FIGS. 2 and 3, it will be seen that a wide additional electrode 21 is disposed on the first dielectric plate 13 and covered by the first dielectric coating 15 so as to define additional gas discharge cells in cooperation with the second set of electrodes 12. In the illustrated example, the electrodes 11 and 12 are driven in a time division fashion. More particularly, the first-set electrodes 11 are supplied with high-frequency voltages exemplified at 23 selectively in compliance with a desired display while the second-set electrodes 12 are cyclically supplied with high-frequency voltages indicated at 24. The additional electrode 21 is supplied with an additional high-frequency voltage represented at 25 in synchronism with the high-frequency voltages supplied to the first-set electrodes 11. As is known in the art, each pulse depicted in FIG. 2 consists of a train of high-frequency voltages or pulses. One or more gas discharges are thereby produced, selectively and successively as the second-set electrodes 12 are scanned, in the gas discharge cells indicated by dots to exhibit a display consisting of a plurality of units. Thus, each gas discharge cell, hereafter called a first gas discharge cell, defined by conventional electrodes 11 and 12, hereafter called first electrodes 11 and 12, serves as a picture element of the displays to be exhibited by the plasma display panel. At the same time, gas discharges are cyclically produced in the additional gas discharge cells, hereafter called second gas discharge cells.

Figure 4:
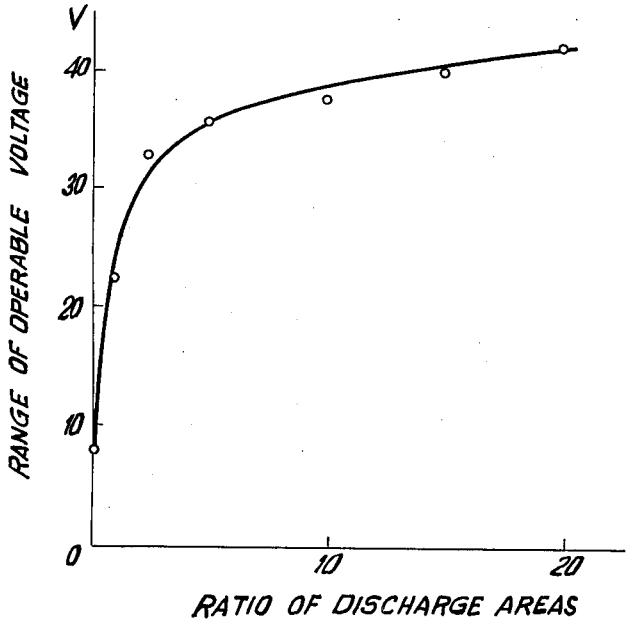
FIG. 4 shows the ranges of operable voltage of a conventional plasma display panel and those according to this invention versus the ratios of the discharge areas of the panels.

Referring now to FIG. 4, the function of the second electrode 21 will be described in relation to a conventional plasma display panel and several other panels according to this invention. The panels under consideration have similar structures exemplified in FIG. 2 except for the second electrodes 25 of various widths including zero. The first-set electrodes 11 and the second-set electrodes 12 are supplied with high-frequency voltages of an equal peak-to-peak or effective value, which is varied for the purpose of testing. The abscissa shows the ratio of a discharge area of a second gas discharge cell to that of a first gas discharge cell. The discharge area means that the cross-sectional area of the gas-filled space 19 in which a high-frequency gas discharge takes place from one of the electrodes 11 and 21 arranged on the first dielectric plate 13 to a corresponding second-set electrode 12 and vice versa. Here, the discharge areas of the first gas discharge cells are equal. Those of the second gas discharge areas are also equal. The ordinate shows the range of operable voltages, namely, the allowable range of those peak-to-peak or effective values of the high-frequency voltages which cause the panel to exhibit satisfactory displays. More particularly, at least one picture element will be spuriously displayed even with a plasma display panel according to this invention during one cycle of the time division drive if the voltage rises too much. The range of operable voltage is the difference between the minimum voltage for firing the desired gas discharge cells and the highest voltage up to which no spurious gas discharge occurs in the first gas discharge cells. It will be seen that the operable range rapidly grows larger to about 35 volts with an increase of the ratio of two and thereafter approximately saturates. It is therefore desirable that the discharge area of the second gas discharge cells be at least twice as broad as that of the first gas discharge cells. In the design of a plasma display panel including the the first electrodes 11 and 12 in a matrix form, use may be made of a second electrode 21 which is at least twice as wide as the wider of the first-set and second-set electrodes 11 and 12. The second electrode 21 is preferably disposed on one of the dielectric plates 13 and 14 outwardly of the electrodes 11 or 12 arranged thereon.

Referring again to FIGS. 2 and 3, a plasma display panel was constructed comprising transparent first-set electrodes 11, each 0.6 mm wide, on a transparent first dielectric plate 13 with a pitch of 0.84 mm, second-set electrodes 12 of silver paint, each 0.5 mm wide, on a second dielectric plate 14 also with a pitch of 0.84 mm, and a second electrode 21 of silver paint, 4.5 mm wide (the ratio of discharge areas being about one to seven), on the first dielectric plate 13. With seven first-set electrodes 11 and five second-set electrodes 12 assigned to each unit of a display, the panel was driven in the above-described time division fashion to exhibit a display of 32 units or letters of W, most frequently erroneously displayed by conventional plasma display panels of similar structures. When the panel was driven as a conventional plasma display panel with no high-frequency voltage applied to the second electrode 21, the range of operable voltage was only 5 volts. When a high-frequency voltage 25 of the same value as those 23 supplied selectively to the first-set electrodes 11 is supplied to the second electrode 21, the operable range became 36 volts.

Figure 5:
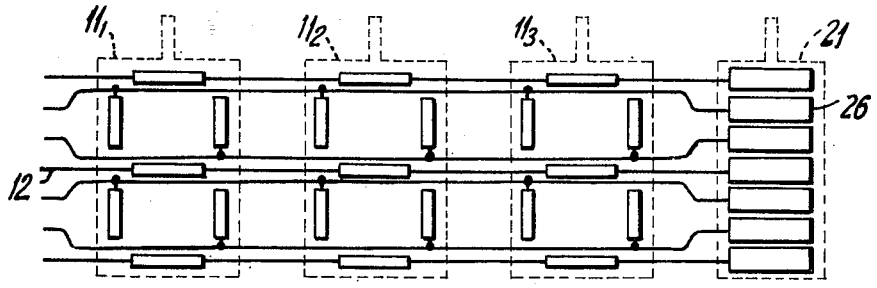
FIG. 5 schematically shows an electrode arrangement of a plasma display panel according to a second embodiment of this invention.

Referring to FIG. 5, a plasma display panel according to a second embodiment of this invention comprises three first-set electrodes $\mathbf{11}_1$, $\mathbf{11}_2$, and $\mathbf{11}_3$ and seven second-set electrodes 12 having three sets of segments, each arranged to approximate a figure eight for use in displaying selected numerals 0 through 9 one at a time. Each of the first-set electrodes 11 has a broad portion facing the segments of a set. A second electrode 21 is disposed parallel to the first-set electrodes 11. The second-set electrodes 12 are provided with wide portions 26, respectively, facing the second electrode 21. The segments are not necessarily of an equal area. It will readily be understood that a plasma display panel according to the second embodiment becomes quite lengthy when the wide portions 26 are of the same width as the common width of the segments and when the discharge area of the second gas discharge cells is made seven times as broad as the broadest discharge area of the first gas discharge cells as described in the next preceding paragraph.

Figure 6:
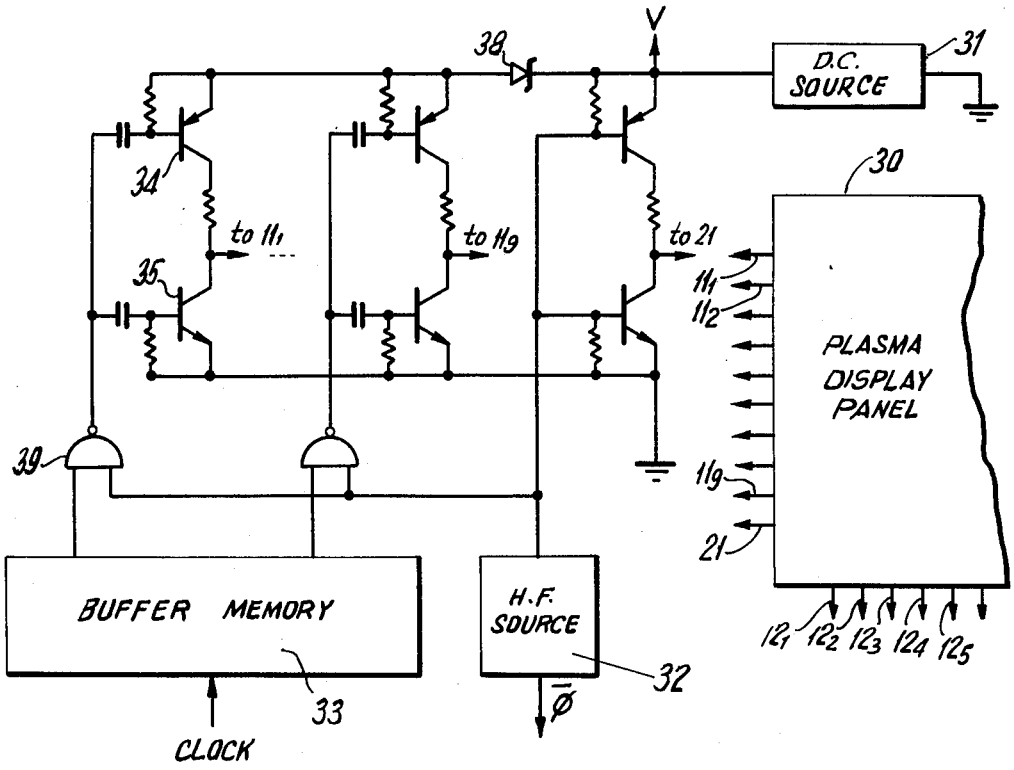
FIG. 6 shows a circuit according to this invention for supplying high-frequency voltages to electrodes disposed on one of the dielectric plates of a plasma display panel according to this invention.

Referring again to FIGS. 2 and 3 and also to FIG. 6, a test plasma display panel was manufactured with only one first-set electrode 11, a second electrode 21, and a plurality of second-set electrodes 12. The electrodes 11 and 21 were supplied by a driving circuit therefor with high-frequency voltages of a lower and a higher value, respectively, while the second-set electrodes 12 were cyclically supplied with high-frequency voltages. More particularly, the driving circuit for the first-set and second electrodes 11 and 21 of a plasma display panel 30 is set into operation by a D.C. power source 31 of a D.C. voltage V nearly 20 volts higher than a half of the firing voltage of the first and second gas discharge cells, a high-frequency pulse generator 32 for a first train $\phi$ of high-frequency pulses, and a buffer memory 33 operable in response to clock pulses and to selection of the display to be made by the panel 30. The circuit being illustrated comprises, for each of the electrodes 11 and 21, a pair of PNP and NPN transistors 34 aned 35 whose collector electrodes are connected together through a resistor and to a pertinent electrode 11, and 21. The transistor pair for the second electrode 21 is supplied directly from the D.C. source 31 and controlled continuously by the pulse train $\phi$. The second electrode 21 is therefore supplied with a continuous train of high-frequency pulses having a peak-to-peak value nearly equal to the D.C. voltage V. The transistor pairs for the first-set electrodes 11 are supplied with the D.C. voltage V through one or more reversed biased Zener diodes 38 and with the pulse train $\phi$ through respective NAND gates 39 selectively enabled by the output signal or signals of the buffer memory 33. The first-set electrodes 11 are thus selectively supplied with one or more trains of high-frequency pulses having a peak-to-peak value reduced by the voltage drop developed across the Zener diode 38.

Figure 7:
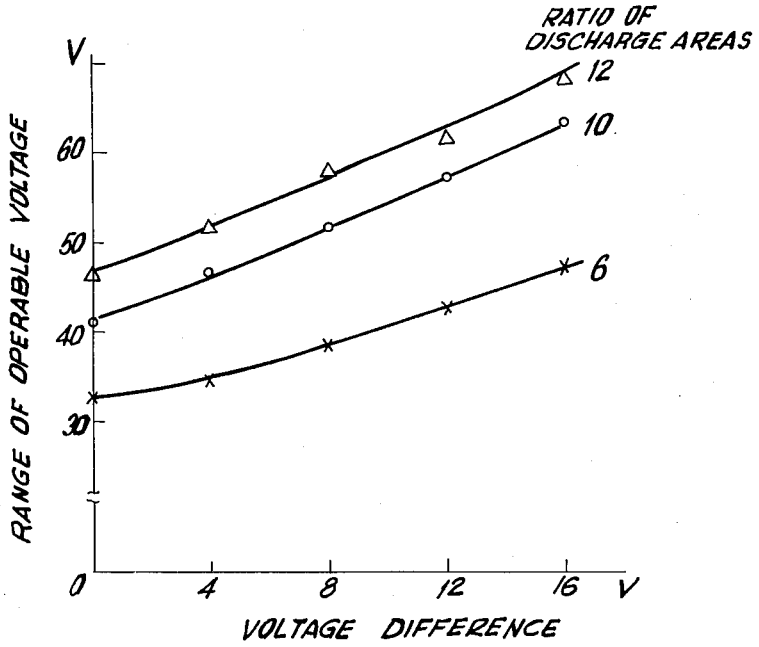
FIG. 7 shows the ranges of operable voltage of plasma display panels according to this invention versus voltage differences derived, for example, by the circuit shown in FIG. 6.

Referring to FIG. 7, each of test plasma display panels manufactured in the manner described above with the ratio of discharge areas set at 6, 10, and 12 was driven together with the cyclic pulse trains by the circuit illustrated with reference to FIG. 6 but having only one driving circuit element for the single first-set electrode 11 and that for the second electrode 21. The range of operable voltage was observed with the voltage difference between the high-frequency pulses supplied to the second electrode 21 and those supplied to the first-set electrode 11 varied. It has now been found that the operable range monotonically rises with an increase in the voltage difference. This shows that the effective discharge area of the second gas discharge cells is broadened by rendering the peak-to-peak or effective value of the high-frequency voltages, hereafter called first high-frequency voltages, applied selectively across the first gas discharge cells higher than that of the high-frequency voltage, now called a second high-frequency voltage, applied across the second gas discharge cells. By way of example, a plasma display panel, similar to that described above together with practical numerical dimensions of the electrode arrangement, was manufactured by the use of a second electrode of silver paint, 6.0 mm wide (the ratio of discharge areas being ten) and driven in the manner described hereinabove in this paragraph. With the use of a second high-frequency voltage of the same value as the first high-frequency voltages, the range of operable voltage was 40 volts. When the voltage difference between the first and second high-frequency voltages was raised to 16 volts, the operable range rose to 63 volts.

Figure 8:
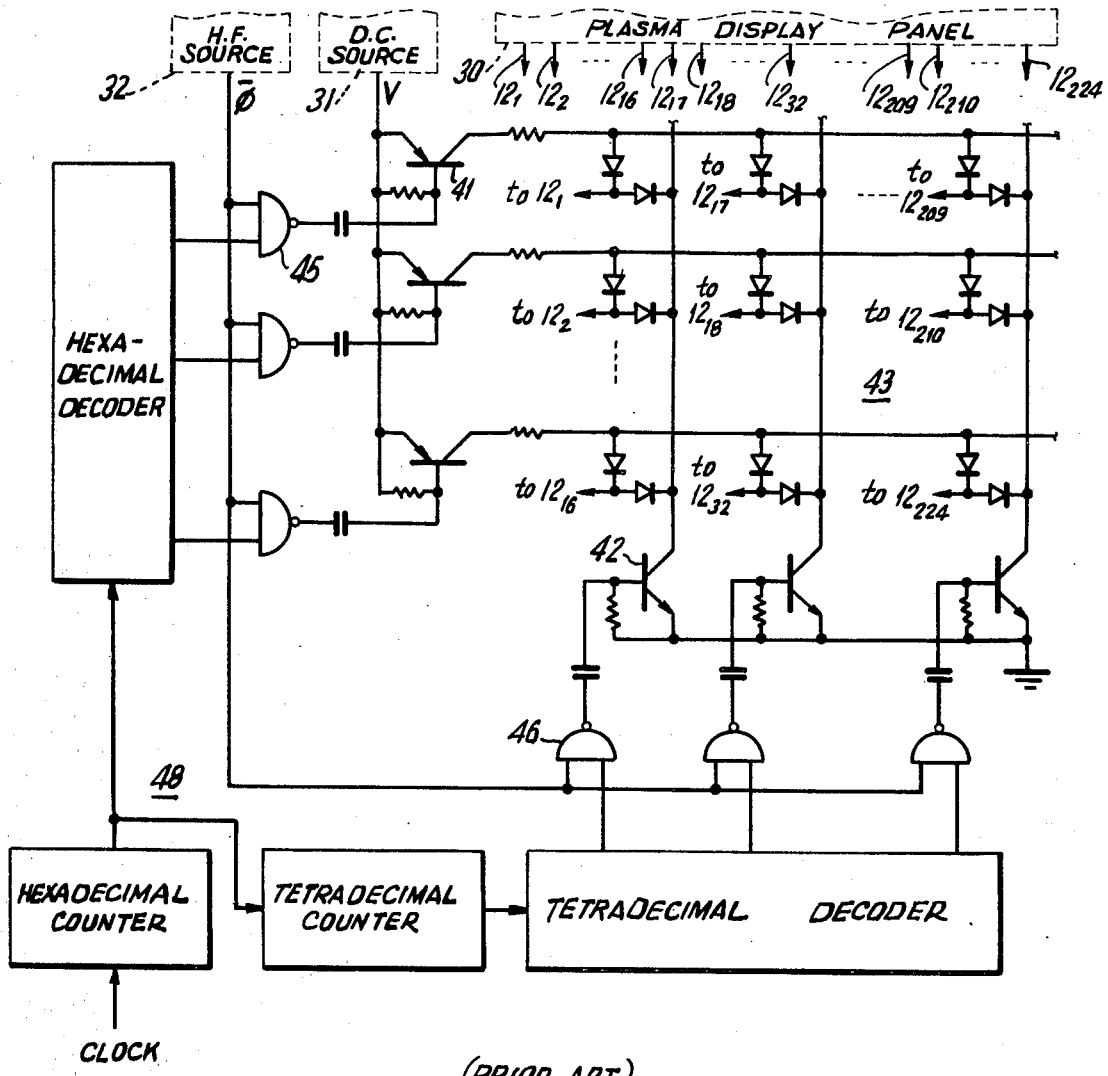
(PRIOR ART) FIG.8
FIG. 8 shows a circuit for supplying high-frequency voltages to electrodes disposed on one of the dielectric plates.

Finally referring to FIG. 8, a driving circuit for cyclically supplying high-frequency pulse trains to the second-set electrodes 12 will briefly be described in order that the instant specification may be complete. For use together with the circuit illustrated with reference to FIG. 6, the cyclic pulse train supplying circuit is operated by the D.C. voltage V, a second train $\overline{\phi}$ of high-frequency pulses with their polarity reversed with respect to the pulses of the first train $\phi$, and the clock pulses. The circuit comprises a plurality of PNP transistors 41 and a plurality of NPN transistors 42 connected through a diode matrix 43 between the D.C. power source 31 and ground so as to define a plurality of matrix points of the diode matrix 43. The PNP and NPN transistors 41 and 42 are rendered cyclically conductive by the second pulse train $\overline{\phi}$ supplied thereto through respective NAND gates 45 and 46 which are enabled by the output signals of a control circuit 48 supplied with the clock pulses. When one each of the PNP and NPN transistors 41 and 42 is turned on, a high-frequency pulse train of a peak-to-peak value nearly equal to the D.C. voltage V is supplied to the second-set electrodes $\mathbf{12}_1$, $\mathbf{12}_2$, . . . , $\mathbf{12}_{16}$, $\mathbf{12}_{17}$, $\mathbf{12}_{18}$, . . . , $\mathbf{12}_{32}$, . . . , $\mathbf{12}_{209}$, $\mathbf{12}_{210}$, . . . , and $\mathbf{12}_{224}$ which is connected to the matrix point defined by a pair of PNP and NPN transistors 41 and 42 rendered conductive.

While this invention has thus far been described in connection with plasma display panels according to several preferred embodiments and a driving circuit therefor according to a sole embodiment and in connection with several modifications, other modifications to such embodiments are possible within the scope of the appended claims. By way of example, this invention is equally applicable to a plasma display panel comprising a center dielectric plate between the first and second dielectric plates 13 and 14, the center plate having a plurality of perforations therethrough at the respective positions of the first gas discharge cells. The center plate may have either a continuous perforation or a plurality of discrete perforations therethrough at the positions of the respective second gas discharge cells. Instead of a continuous dielectric coating 15 or 16 common to the electrodes 11 and 21 or 12, a plasma display panel may comprise discrete dielectric coatings on the individual electrodes 11, 12, and 21. Either of the first-set and second-set electrodes 11 and 12 may cyclically be supplied with high-frequency voltages. Without resorting to the time division or time sharing drive, a plasma display panel according to this invention may be driven by selecting pertinent first electrodes 11 and 12 and supplying high-frequency voltages thereto. Similarly, a driving circuit according to this invention may not necessarily comprise cyclic high-frequency voltage supplying means but a pair of circuits for supplying the high-frequency voltages selectively to the first-set and second-set electrodes 11 and 12. The high-frequency voltages supplied to the first-set electrodes 11 may not have a peak-to-peak or effective value equal to that of the high-frequency voltages supplied to the second-set electrodes 12. Incidentally, the gas discharges produced in the second gas discharge cells additionally serve to produce ions of the ionazable gas in the first gas discharge cells, thereby reducing the delay of firing of the gas discharges in the first gas discharge cells.

The above embodiments of the invention are intended merely to illustrate the concept of the invention. These embodiments cannot be construed to be a limitation on the scope of the invention, as many modifications and variations of the preferred embodiments that fall within the scope of the invention will occur to those skilled in the art.

What is claimed is:

1. A gas discharge panel for exhibiting a selected variable display including first and second dielectric plates, means for hermetically sealing said plates with an ionizable gas therebetween, a set of first electrodes on each of said plates for defining a plurality of first gas discharge cells that form picture elements of the displays to be exhibited by said panel, said first electrodes being spaced from said first gas discharge cells by a dielectric coating, a second electrode on said first plate for defining a plurality of second gas discharge cells in cooperation with said first electrodes disposed on said second plate, said second electrodes being spaced from said second gas discharge cells by a dielectric coating, and means effective to increase the effective discharge area of said second discharge cells to an effective discharge area that is at least twice as large as the largest discharge area of said first gas discharge cells, said last-named means comprising a circuit for driving said gas discharge panel including first circuit means for selectively supplying said first gas discharge cells with a first high-frequency voltage of a first common peak-to-peak value to make said panel exhibit said selected display, and second circuit means for supplying said second gas discharge cells with a second high-frequency voltage of a second peak-to-peak value higher than said first peak-to-peak value.

2. A gas discharge panel as set forth in claim 1, wherein said second peak-to-peak value is about ten volts higher than said first peak-to-peak value.

3. The apparatus of claim 1, wherein said second circuit means applies said second high-frequency voltage across said second gas discharge cells whenever said first means applies said first high-frequency voltages across said first gas discharge cells.

4. The apparatus of claim 1, wherein said second peak-to-peak value is about ten volts higher than said first peak-to-peak value.

5. The apparatus of claim 1, wherein said first and second high-frequency voltages are of a common high frequency.

6. The apparatus of claim 3, operable in cooperation with a source of D.C. voltage, wherein said first means is operatively coupled to said source for reducing said D.C. voltage by a predetermined voltage.

* * * * *